United States Patent [19]

Gotanda

[11] 4,399,673

[45] Aug. 23, 1983

[54] LOCK DEVICE

[76] Inventor: Motohiro Gotanda, No. 1802-10,, Nakabyo, Abiko City, Chiba Prefecture, Japan

[21] Appl. No.: 320,589

[22] Filed: Nov. 12, 1981

[30] Foreign Application Priority Data

Nov. 22, 1980 [JP] Japan ..... 55-164049

[51] Int. Cl.[3] ..... E05B 47/00

[52] U.S. Cl. ..... 70/276; 70/278; 70/413

[58] Field of Search ..... 70/276, 277, 278, 413; 335/207

[56] References Cited

U.S. PATENT DOCUMENTS 2,966,789 1/1961 Hall ..... 70/276

4,287,733 9/1981 Gomez-Olea ..... 70/276

FOREIGN PATENT DOCUMENTS 2724025 12/1977 Fed. Rep. of Germany ..... 70/276

2080390 2/1982 United Kingdom ..... 70/276

*Primary Examiner*—Robert L. Wolfe

*Attorney, Agent, or Firm*—Larson and Taylor

[57] ABSTRACT

A lock device comprising a fixed cylindrical member, a rotatable member fitted into said fixed member and rotated to cause a dead bolt to be reciprocated and having a key hole extending along the axial center line thereof, and a means for locking said fixed member to said rotatable member by a plurality of permanent magnets arranged according to a predetermined pole pattern, wherein said locking means can be released so as to enable the lock device to be locked and unlocked when a key having a plurality of permanent magnets embedded on both sides thereof according to the predetermined pole pattern is inserted into the key hole, characterized by a fixed guide cylinder rotatably housed in said fixed member, an engaging means for fixing the fixed guide cylinder to said fixed member and releasing the fixed guide cylinder from said fixed member, a pattern reading means for detecting the pole pattern of said key, and a driving means for driving said engaging means to fix said fixed guide cylinder to the fixed member and to release said fixed guide cylinder from said fixed member only when the pole pattern read out by said pattern reading means coincides with that previously store.

1 Claim, 17 Drawing Figures

LOCK DEVICE

BACKGROUND OF THE INVENTION

The present invention relates to a lock device wherein a locking mechanism locked and unlocked using a conventional magnetic key is arranged to have memory function and to be locked and unlocked only when the key inserted into the locking mechanism corresponds to the key code previously stored in the memory, thus enabling any keys for other rooms to be used to lock and unlock the locking mechanism when they are previously stored in the memory.

It has become necessary these days that rooms in which computers, safes and other confidential matters are housed are arranged to be locked and unlocked by specified persons or at specified times from the viewpoint of keeping confidential matters and preventing crimes and accidents.

The card lock is one conventional lock device of this type. The card lock uses the magnetic card and is locked and unlocked by the magentic card when the code recorded on the magnetic card corresponds to the code stored in the card reading means. However, the card lock using the magnetic card comprises a combination of card reading means and electrical locking mechanism, which are separated from each other to thereby make the card lock large-sized. In addition, the combination of electrical locking mechanism and magnetic card once determined can not be changed easily.

SUMMARY OF THE INVENTION

According to the present invention is provided a novel lock device having a locking mechanism of tripple construction and capable of completely eliminating any chance of using the key wrongfully wherein the conventional magnetic key having pieces of magnet embedded at that portion thereof which is to be inserted into the key hole and being intended to lock and unlock the conventional lock device when the arrangement of embedded pieces of magnet in the key corresponds to the arrangement of magnets housed in the locking mechanism of conventional lock device can be used; when three keys are assigned to every room in a hotel and one of them is kept and managed every room at the front as a regular, emergency or master key, the other two keys can be mixed with those of other rooms and when a person is to check in a room, a key can be selected from these mixed ones and handed to him after the room number of his room and the arrangement of embedded pieces of magnet in the key are stored in a memory so as to enable him to lock and unlock his room using the key during his stay in the hotel; when he is to check out, the contents of key stored in the memory can be erased from the memory making it impossilbe to lock and unlock his room using the key and when other persons try to enter his room using different key, an alarm is sounded so as not to allow other persons to lock and unlock his room wrongfully; and in the case of memory accident or power stoppage, the regular, emergency or master key kept and managed at the front can be used to lock and unlock his room.

An object of the present invention is therefore to provide a lock device having a memory function and a locking mechanism of tripple construction so as to prevent the wrongful use of a key.

Another object of the present invention is to provide a lock device having a memory function and a locking mechanism of tripple construction so as to allow the key of a room to be used in any other rooms in a hotel, so that the free use of key can be enhanced extremely.

A further object of the present invention is to provide a lock device allowing a room to be unlocked by a regular key specifically assigned to the room in the case of memory accident or power stoppage.

A still further object of the present invention is to provide a lock device extremely small-sized.

These and other objects can be achieved by a lock device of the present invention having a locking mechanism and an electrical circuit and can also become apparent from the following detailed description made relating to an embodiment of the present invention with reference to the drawings. It should be understood that any variations and modifications of locking mechanism and electrical circuit are included in the claim appended hereto.

BRIEF DESCRIPTION OF THE DRAWINGS

FIGS. 6*a* through 6*d* show a rotating member in which FIG. 6*a* is a front view thereof, FIG. 6*b* is a sectional view taken along a line C—C in FIG. 6*a*, FIG. 6*c* is a plane view showing the rotating member rotated by 90° relative to that shown in FIG. 6*b*, and FIG. 6*d* is a sectional right side view of rotating member.

FIGS. 7*a* through 7*c* show a driving piece in which FIG. 7*a* is a front view, FIG. 7*b* is a sectional right side view, and FIG. 7*c* is a back side view.

DETAILED DESCRIPTION OF THE PREFERRED EMBODIMENT

The present invention will be now described in detail with reference to the drawings.

Figure 1:
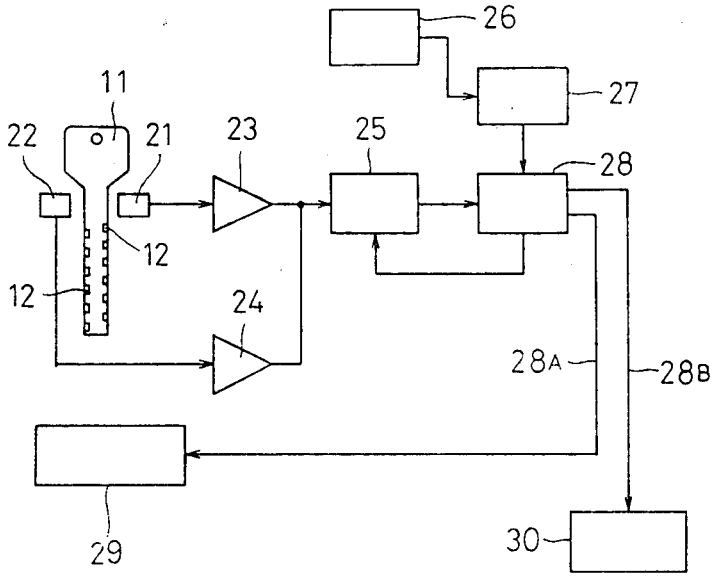
FIG. 1 is a block diagram showing theoretically a lock device of the present invention.

FIG. 1 is a block diagram showing the present invention theoretically. Numeral 11 represents a key having a plurality of permanent magnet pieces 12 embedded on both sides of that portion thereof which is to be inserted into the key hole, said pieces of magnet 12 being arranged in such a way that polarities of S and N have a predetermined pole pattern. Numerals 21 and 22 denote sensors such as Hall elements which serve to detect the direction of magnetic field and which are arranged in a cylinder 32 of a locking mechanism to detect polarities of permanent magnet pieces 12 embedded in the key 11. Numerals 23 and 24 represent amplifiers which serve to amplify electrical outputs applied from sensors 21 and 22. Numeral 25 represents a memory which successively stores outputs applied from amplifiers 23 and 24. Numeral 26 denotes a key code reading section which causes a pole pattern code according to the arrangement of permanent magnet pieces 12 embedded in the key 11 to be stored in a memory 27 in such a way that the key 11 is inserted directly into the key code reading section or that the pole pattern code itself is inputted to the key code reading section. Numeral 28 represents a comparator for comparing the contents stored in the memory 25 with those stored in the memory 27 and outputting the result as a coincident output 28A or a non-coincident output 28B. When coincident output 28A is generated, a driving section 29 is driven to allow the locking mechanism to be locked and unlocked as will be later described in detail. When non-coincident output 28B is outputted, an alarm means 30 is sounded indicating that the key inserted is wrong.

In the case of lock device having such arrangement as described above, the polarity of each of permanent magnet pieces 12 embedded on both sides of key 11 is successively detected by sensors 21 and 22 as the key 11 is inserted into the cylinder 32 of locking mechanism and an output corresponding to the polarity of each of permanent magnet pieces 12 detected is successively stored in the memory 25. Therefore, comparison between memories 25 and 27 can be easily achieved by the comparator 28, and when the contents stored in memories 25 and 27 are coincident with each other, the driving means 29 is operated to allow the key 11 to be turned.

Figure 2:
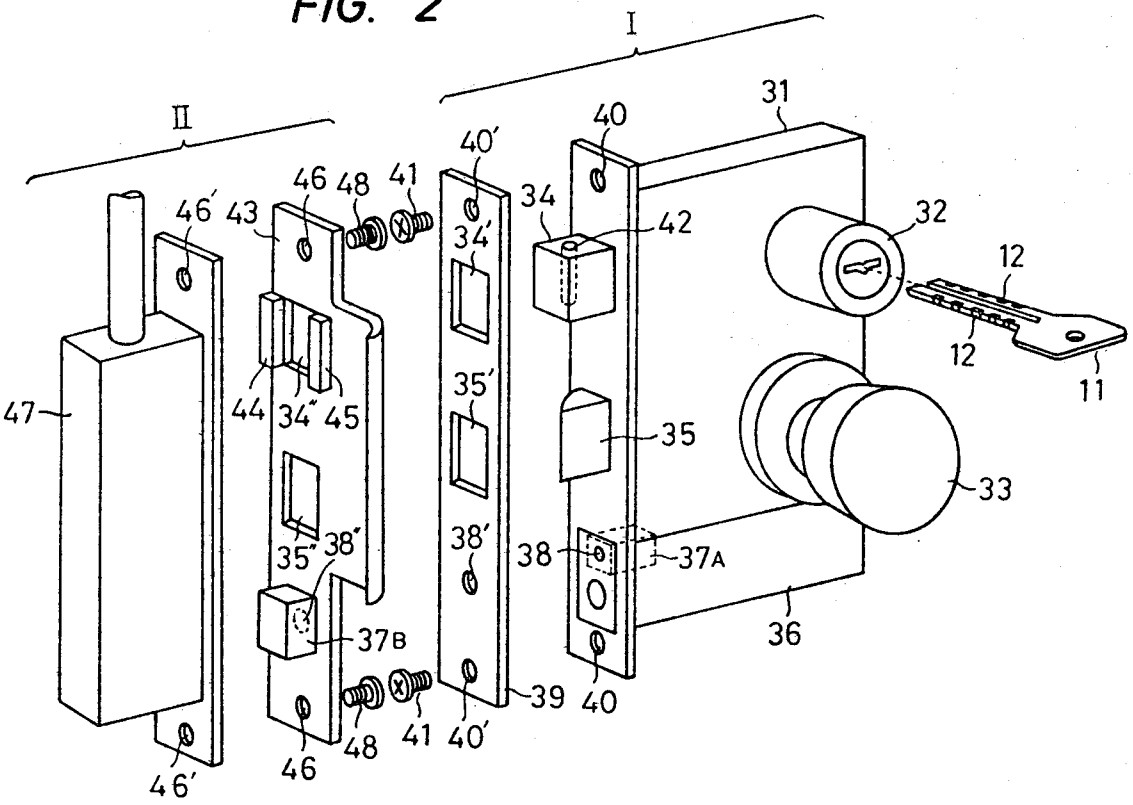
FIG. 2 is a perspective view showing a locking mechanism decomposed, which is an embodiment of the present invention.

FIG. 2 is a perspective view showing a disassembled locking mechanism, which embodies the principle of the present invention. A symbol I denotes a locking section attached to a door and a symbol II a fixed section attached to a pillar, wall or the like.

In the locking section I: a cylinder 32 and a knob 33 are attached to a case 31 and when the key 11 is inserted into a hole provided in the cylinder 32 and turned (it is determined according to the principle of the present invention as described referring to FIG. 1 whether or not the key 11 can be turned), a dead bolt 34 is entered into and projected from the case 31 to unlock and lock the lock device. A latch bolt 35 is projected from and entered into the case 31 by turning the knob 33 to thereby allow the door to be closed and opened. Numeral 36 represents another case which is arranged under the case 31 and which houses an electronic circuit and a battary therein, said electronic circuit serving to process output signals applied from sensors 21 and 22 arranged in the locking section and shown in FIG. 1 and also to process control signals and the like which are applied to the driving means 29. Instead of battery which is used as a power source, a conductive hinge for use to the door to which the locking section I is attached may be used so as to allow current to be supplied therethrough. 37A denotes a light transmitting and receiving element which forms a photo-coupler and which is attached to the front face of case 36 to transmit and receive light through a hole 38. 39 represents a front plate attached to front faces of cases 31 and 36 and having holes 34′ and 35′ through which the dead bolt 34 and latch bolt 35 are entered into and projected from the case 31, a hole 38′ through which light passes to the light transmitting and receiving element 37A, and holes 40′ through which screws 41 are screwed into holes 40 of cases 31 and 36 to attach the front plate to the door. A permanent magnet 42 is embedded in the dead bolt 34.

In the fixed section II: a strike plate 43 is provided with holes 34″ and 35″ through which the dead bolt 34 and latch bolt 35 pass, and a hole 38″ opposite to the hole 38′. A light transmitting and receiving element 37B attached to the back side of hole 38″ is combined with the light transmitting and receiving element 37A arranged in the locking section I to form the photo-coupler. 44 and 45 denote reed switches which are closed and opened according to the reciprocating movement of dead bolt 34 to inform that the lock device is locked or unlocked. 46 represent holes through which the strike plate 43 is attached. 47 denotes a case covering the back side of strike plate 43 and provided with holes 46′ opposite to holes 46. This case 47 is arranged in a recess formed in the pillar or the like and attached to the pillar or the like using screws 48 screwed through holes 46 and 46′.

The locking mechanism thus arranged allows the dead bolt 34 to be reciprocated so as to lock and unlock the locking mechanism when the key 11 is inserted into the cylinder 32 and turned.

The portion of cylinder 32 will be now described in detail referring to FIGS. 3 through 7.

Figure 3A:
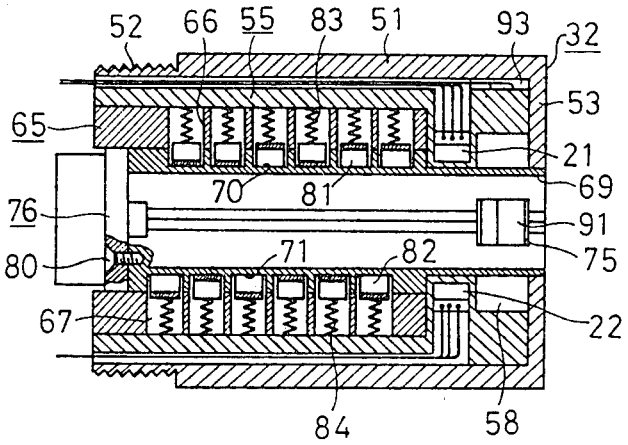
FIGS. 3*a* and 3*b* are sectional side views showing the main portion of a cylinder into which a key is not inserted wherein the main portion of cylinder shown in FIG. 3*a* is rotated by 90° relative to that shown in FIG. 3*b*.
Figure 3B:
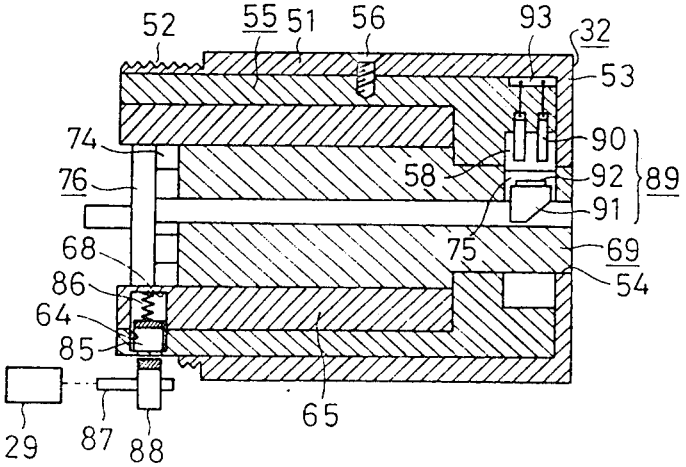
Figure 4A:
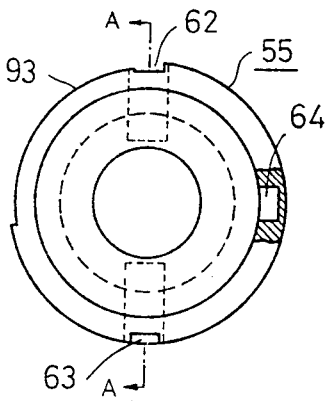
FIG. 4*a* is a front view showing a fixed guide cylinder and FIG. 4*b* is a sectional view taken along a line A—A in FIG. 4*a*.
Figure 4B:
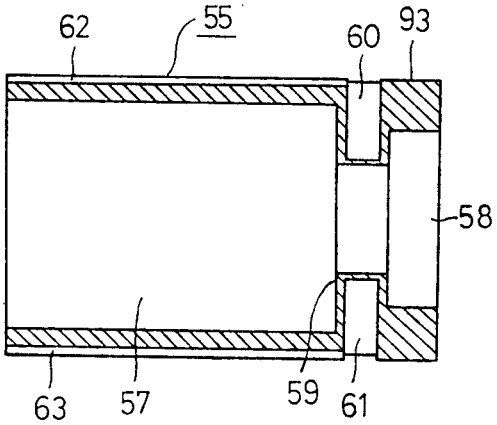
Figure 5A:
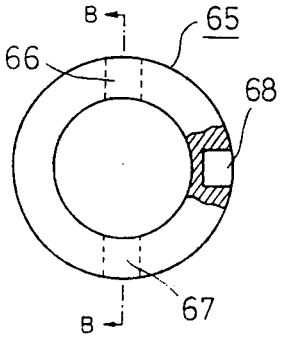
FIG. 5*a* is a front view showing a fixed member and FIG. 5*b* is a sectional view taken along a line B—B in FIG. 5*a*.
Figure 5B:
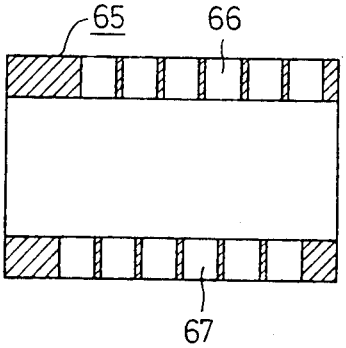
Figure 6A:
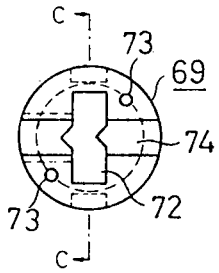
Figure 6B:
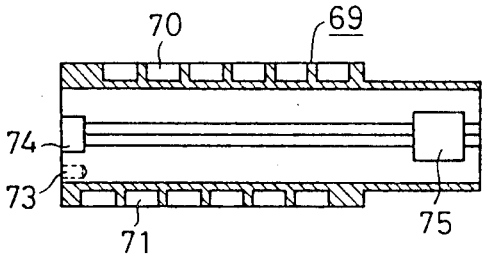
Figure 6D:
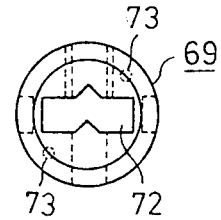
Figure 6C:
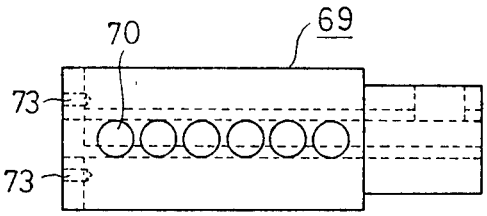
Figure 7A:
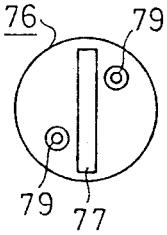
Figure 7B:
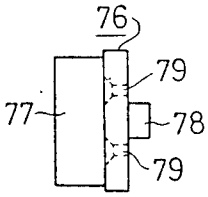
Figure 7C:
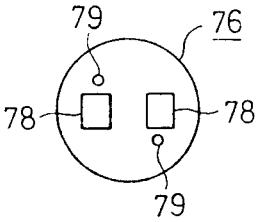

FIGS. 3*a* and 3*b* are sectional side views showing the main portion of cylinder 32 when the key 11 is not inserted. Numeral 51 represents an outer cylinder havng a threaded portion 52 formed on the outer circumference of an end thereof and a hole 54 formed at a front plate 53 of the other end thereof. The outer cylinder 51 is attached to the case 31 in such a way that the threaded portion 52 thereof is screwed into a hole formed in the case 31 shown in FIG. 2. Numeral 55 denotes a fixed guide cylinder fitted into the outer cylinder 51 and fixed integral thereto by means of a screw 56. The fixed guide cylinder 55 includes hollow portions 57 and 58 and a stepped portion 59, as shown in FIGS. 4*a* and 4*b*. Holes 60 and 61 (FIG. 4*b*) are formed at the stepped portion 59 to house sensors 21 and 22 therein, respectively, and recesses 62 and 63 (FIGS. 4*a* and 4*b*) are also formed on the outer surface of fixed guide cylinder extending from their corresponding recesses 62 and 63 along the longitudinal axis of fixed guide cylinder 55 so as to lead the connecting lines of sensors 21 and 22 outside. Sensors 21 and 22 housed in holes 61 and 62 as shown in FIG. 3*a* are fixed by fixing material injected into holes 61 and 62. 64 represent a blind hole (FIG. 3*b*, FIG. 4*a*) in which a bar-shaped permanent magnet, which will be described later, is housed. Numeral 65 denotes a fixed cylindrical member having a shape as shown in FIGS. 5*a* and 5*b*. Namely, a row of through-holes 66 having a predetermined pitch therebetween is formed in the upper side of fixed cylindrical member 65 while a row of through-holes 67 in the lower side thereof, each of through-holes 66 being shifted by a half pitch from each of through-holes 67. The fixed member 65 is rotatably housed in the hollow portion 57 of fixed guide cylinder 55. Numeral 68 represents a blind hole positioned opposite to the blind hole 64 of fixed guide cylinder 55. 69 denotes a rotatable member and two rows of blind holes 70 and 71 opposite to each other and having the predetermined pitch are formed in the outer circumference of rotatable member 69, each of blind holes 70 being shifted by the half pitch from each of blind holes 71, as shown in FIGS. 6*a* through 6*d*. 72 denotes a key hole into which the key 11 shown in FIG. 1 is inserted. Screw holes 73 and a stepped portion 74 are formed on the front end face of rotatable member 69. Numeral 75 represents a through-hole. 76 denotes a driving piece which has a projection 77 on the front end face and projections 78 on the back end face and which is provided with through-holes 79, as shown in FIGS. *7a* through *7c*, said projection 77 being engaged with a member (not shown) through which the dead bolt is reciprocated, said projections 78 being engaged with the stepped portion 74 of rotatable member 69, and said through-holes 79 corresponding to screw holes 73, respectively. The driving piece 76 is fixed to the rotatable member 69 by means of a screw 80.

In FIG. *3a*, numerals 81 and 82 represent bar-shaped permanent magnets and that portion of each of these magnets to which hatching is applied in the drawings represents a North pole N while the other blank portion thereof a South pole S. Each of permanent magnets 81 and 82 is housed in one of through-holes 66 and 67 of fixed member 65 and in its corresponding one of blind holes 70 and 71 of rotatable member 69 and urged by a compression spring 83 or 84 against the bottom of blind hole in which it is housed. It is determined according to a pole pattern code which of poles S and N should be arranged upper side or lower side. In the case of upper permanent magnets 81 shown in FIG. *3a*, the arrangement of poles is in the order N, N, S, N, S and S on the upper side of magnets and in the order S, N, S, N, N and S on the lower side thereof.

In FIG. *3b*, numeral 85 represents a permanent magnet similar to those denoted 81 and 82. The permanent magnet 85 is housed in the blind hole 64 of fixed guide cylinder 55 and in the blind hole 68 of fixed member 65 and urged by a compression spring 86 against the bottom of blind hole 64. 87 denotes a rotatable shaft which is associated with the driving portion 29 and to which a permanent magnet 88 is fixed. That portion of each of these magnets 85 and 88 to which hatching is applied in the drawings represents pole N as already described above. 89 represents a switch for turning ON and OFF the output circuit which causes locking and unlocking operations to be achieved. The switch 89 includes contacts 90 arranged in the hollow portion 58 and fixed to the fixed guide cylinder 55, a push button 91 having a conductive piece 92 formed on that surface thereof which faces contacts 90 and projecting into the key hole 72 when the key 11 is not inserted, and a recess 93 formed on a part of outer circumference of fixed guide cylinder 55 as shown in FIG. *4a* so as to connecting lead lines of contacts 90 outside.

Figure 8:
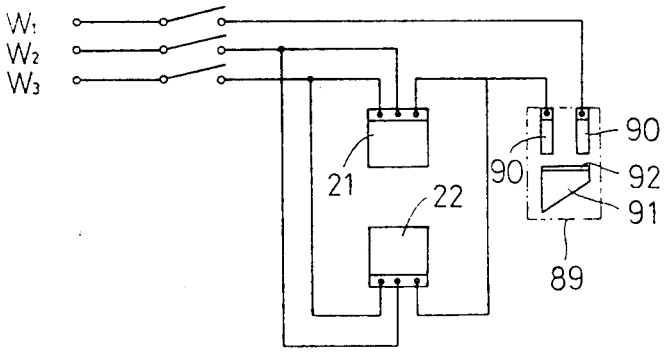
FIG. 8 is a circuit diagram showing an electrical circuit employed in the locking mechanism of the present invention.

FIG. 8 shows an electrical circuit employed in the lock device of the present invention, in which $W_1$ denotes a power source line, $W_2$ a signal and power souce line and $W_3$ a signal line.

There will be now described how the lock device of the present invention is operated.

FIGS. *3a* and *3b* show the position of permanent magnets 81 and 82 when the key 11 is not inserted into the key hole 72, under which each of permanent magnets 81 and 82 is urged by the compression spring 83 or 84 against the bottom of one of blind holes 70 and 71 in which it is housed. The permanent magnet 85 is also urged by the compression spring 86 and drawn by the pole N of permanent magnet 88 against the bottom of blind hole 64. The rotatable member 69 and fixed member 65, and the fixed member 65 and fixed guide member 55 are repsectively fixed by permanent magnets 81, 82 and 85, so that the driving piece 76 can not be moved to thereby prevent the lock device from being locked and unlocked.

When the regular, emergency or master key 11 is inserted into the key hole 72, poles N and S of permanent magnets 12 embedded in the key 11 repel poles N and S of permanent magnets 81 and 82, so that permanent magnets 81 and 82 are separated from blind holes 70 and 71 into through-holes 66 and 67 against the action of compression springs 83 and 84. The rotatable member 69 is therefore released from the fixed member 65 to freely rotate, thus rotating the driving piece 76 to allow the lock device to be locked and unlocked.

It is at the time of an accident involving the circuit shown in FIGS. 1 and 8 or power stoppage that the master key 11 is used as described above. Even if the push button 91 is pushed by the master key 11 inserted to close contacts 90, neither of sensor 21 nor 22 is operated in this case to cause the pole pattern to be read and the pole pattern code to be outputted. No coincident output 28A is therefore generated and the driving portion 29 is not operated. However, the rotatable member 69 can be rotated as described above, thus allowing the lock device to be locked and unlocked.

When a key 11' (not shown) having pieces of permanent magnet 12 embedded on both sides thereof according to its pole pattern code stored in the memory 27 is inserted into the key hole 72, contacts 90 are closed by the key 11' inserted and sensors 21 and 22 are operated. The pole pattern of key 11' is read out by sensors 21 and 22 and amplified by amplifiers 23 and 24 shown in FIG. 1 to be applied to the memory 25. When the pole pattern of key 11' thus stored in the memory 25 coincides with that stored in the memory 27, coincident output 28A is generated to operate the driving portion 29. The rotation of rotatable shaft 87 causes the permanent magnet 88 to be turned from N to S. As the result, the permanent magnet 85 opposite to the permanent magnet 88 repels the permanent magnet 88 to release the fixed member 65 from the fixed guide cylinder 55 and the fixed member 65 can be thus rotated freely to enable the lock device to be locked and unlocked.

When a key having a plurality of permanent magnet pieces embedded therein whose arrangement of polarities is different in even one instance from that of polarities of magnets arranged in the locking mechanism, a key having a pole pattern different from that stored in the memory 27, or something like a key is inserted into the key hole 72, such operation as described above can not be achieved. And when the pole pattern of key inserted does not coincide with that stored in the memory 27, noncoincident output 28B is generated to cause the alarm 30 to sound an alarm. No coincident output 28A is generated in this case and the driving portion 29 is thus kept unoperative preventing the lock device from being locked and unlocked.

When one or more keys of spare keys collected except the regular key inherent to each of rooms in the hotel are stored in the memory 27 as ground master keys, all of rooms can be locked and unlocked by this or these ground master keys.

When one or more keys of spare keys collected are similarly stored in the memory 27 as floor master keys, all of rooms on a floor can be locked and unlocked by this or these floor master keys.

When persons who can manage these ground and floor master keys are fixed, it can be understood at the front which room is locked and unlocked by the ground or floor master key, who the person is, and when the room is locked and locked, and the management and use of keys can be thus controlled easily at the front.

The lock device of the present invention can be employed in any room in buildings, installations and banks which are required to keep many matters confidential.

According to the present invention as described above, the fixed member is rotatably fitted into the fixed guide cylinder to be released from the latter by the engaging means and the engaging means causes the fixed member to be released from the fixed guide cylinder only when a key whose pole pattern coincides with that stored in the memory is inserted into the key hole. Therefore, any one of a plurality of conventional magnetic keys each having a plurality of permanent magnet pieces embedded on both sides thereof according to a pole pattern can be used when its pole pattern is stored in the memory. The regular key specifically assigned to each of rooms may be used as an emergency or master key in the case of emergency and any one of other keys can be used to any room when its pole pattern is stored in the memory as the key used to the desired room. When the key used to a room is lost, its pole pattern may be erased from the memory, thus preventing the lost key from being used wrongfully to enter the room. The lock device of the present invention enables any one of keys collected from all rooms in the hotel to be used to any room when its pole pattern is stored in the memory as the key used to the desired room and is therefore expected to have a wide application in future.

What is claimed is:

1. A lock device comprising a fixed cylindrical member, a rotatable member fitted into said fixed member and rotated to cause a dead bolt to be reciprocated and having a key hole extending along the axial center line thereof, and a means for locking said fixed member to said rotatable member by a plurality of permanent magnets arranged according to a predetermined pole pattern, wherein said locking means can be released so as to enable the lock device to be locked and unlocked when a key having a plurality of permanent magnets embedded on both sides thereof according to the predetermined pole pattern is inserted into the key hole, said lock device being characterized by a fixable guide cylinder rotatably housed in said fixed member, an engaging means for fixing the fixed guide cylinder to said fixed member and for releasing the fixed guide cylinder from said fixed member, a pattern reading means for detecting the pole pattern of said key, and a driving means, responsive to said pattern reading means, for driving said engaging means to fix said fixed guide cylinder to the fixed member, and to release said fixed guide cylinder from said fixed member only when the pole pattern read out by said pattern reading means coincides with a previously stored pole pattern.

* * * * *